US005554965A

United States Patent [19]

Sundberg

[11] Patent Number: 5,554,965

[45] Date of Patent: Sep. 10, 1996

[54] LUBRICATED VARIABLE RESISTANCE CONTROL HAVING RESISTIVE PADS ON CONDUCTIVE PATH

[75] Inventor: Craig C. Sundberg, Erie, Pa.

[73] Assignee: The Erie Ceramic Arts Company, Erie, Pa.

[21] Appl. No.: 333,418

[22] Filed: Nov. 2, 1994

[51] Int. Cl.[6] ..... H01C 10/00

[52] U.S. Cl. ..... 338/160; 338/154; 338/156; 338/94; 338/75; 338/162; 338/172

[58] Field of Search ..... 338/156, 154, 338/94, 160, 75, 312, 160, 162, 172

[56] References Cited

U.S. PATENT DOCUMENTS

| | | | |
|---|---|---|---|
| 3,673,539 | 6/1972 | Healy et al. | 338/154 |
| 3,697,920 | 10/1972 | Kemp | 338/160 X |
| 3,854,113 | 12/1974 | Fletcher et al. | 338/75 |
| 4,371,862 | 2/1983 | Lipp et al. | 338/174 |
| 4,732,802 | 3/1988 | Bosze et al. | 338/312 X |
| 4,931,764 | 12/1988 | Gaston | 338/185 |
| 5,035,836 | 7/1991 | Gardos et al. | 338/160 X |
| 5,051,719 | 9/1991 | Gaston et al. | 338/162 |
| 5,111,178 | 5/1992 | Bosze | 338/160 |
| 5,155,465 | 10/1992 | Tsuzuki et al. | 338/172 |

OTHER PUBLICATIONS

Technology News, "Porcelainized–steel substrates gain favor for pc boards, hybrids," Jun. 20, 1980, pp. 47–49, 52, 54, 57–58 and 60.

*Primary Examiner*—Teresa J. Walberg
*Assistant Examiner*—Karl Easthom
*Attorney, Agent, or Firm*—Rankin, Hill, Lewis & Clark

[57] ABSTRACT

The present invention provides a lubricated variable resistance control including a substrate having formed thereon an electrical resistance path and an electrical conductive path, and a movable contact electrically bridging the electrical resistance path and the electrical conductive path. Disposed along the electrical conductive path is a non-conductive lubricant material. The electrical conductive path includes one or more protruding ridges spaced along one surface of the electrical resistance path. The ridges are formed of an electrically resistive material and they serve to help insure that the control device does not suffer from current interruptions.

20 Claims, 3 Drawing Sheets

LUBRICATED VARIABLE RESISTANCE CONTROL HAVING RESISTIVE PADS ON CONDUCTIVE PATH

FIELD OF THE INVENTION

The present invention concerns a variable resistance control. More particularly, the present invention concerns a variable resistance control that includes a lubricated electrical conductive path.

BACKGROUND OF THE INVENTION

Variable resistance controls are well known in the prior art. Such controls are utilized in a multitude of electronic devices to control the flow of electrical current. More particularly, variable resistance controls are used in appliances, in stereo and video equipment, and in automobiles. In an automobile, for example, a variable resistance control is utilized to vary the intensity of the lights in the instrument panel. Such variable resistance controls are often commonly referred to as "dimmer switches."

Generally, variable resistance controls comprise an electrical conductive path or collector strip and an electrical resistance path carried on a base. A movable contactor or contact means is provided which bridges the resistance path and the conductive path. The control device also includes some type of a knob which allows a user to rotate or move the contactor relative to the resistance path and the conductor path so as to vary the output resistance of the device. The variable resistance control device may include conductive and resistance paths that are linear or circular (arcuate) in design. Also, the resistance path may be continuous or it may be formed by a series of discreet resistor pads. In a variable resistance control device that employs discreet resistors, as each successive conductive pad is contacted by a movable contactor, an additional single resistor is added in series to the power supply and the load. An example of a prior art variable resistance control having a circular configuration and a continuous resistance path may be found in U.S. Pat. No. 4,371,862. An example of a prior art variable resistance control having a linear configuration and resistance path formed by a series of discrete resistors may be found at page 49 of the article entitled "Porcelainized-Steel Substrates Gain Favor For PC Boards, Hybrids" by John Tsantes which appears in the Jun. 22, 1980 issue of the Electronic Design News.

Variable resistance control devices are utilized both with and without lubricants. In some applications, such as that discussed in U.S. Pat. No. 4,931,764, a variable resistance control is utilized without any type of a lubricant on the resistance or conductive paths of the device. More particularly, the device of the '764 patent is used as part of a sensor in gasoline, thus it is not possible nor desirable to utilize a lubricant. In other applications, it is desirable to utilize a non-conductive lubricant on the conductive path of the variable resistance control device. The lubricant is added to the surface to reduce friction during the wiping of the contactor on the resistance path. In addition to helping to extend the life of the variable resistance control, the lubricant may also provide a more pleasing "feel" as a user adjusts the contactor. Unfortunately, the use of a lubricant in prior art variable resistance controls has created a problem in some applications. More particularly, in some applications the lubricant has interfered with the electrical connection between the conductive path and the contactor. This problem can create interruptions in the otherwise desirable continuous flow of current. Applicant believes that these interruptions are primarily caused by the hydroplaning effect of the lubricant on the contactor.

The present invention provides an improved lubricated variable resistance control that does not suffer from the current interruptions experienced with some prior art lubricated variable resistance controls.

SUMMARY OF THE INVENTION

The present invention provides a lubricated variable resistance control that avoids the problem of discontinuous or interrupted electrical current supply. The variable resistance control comprises a substrate or base having formed thereon an electrical resistance path and an electrical conductive path, and a movable contactor electrically bridging the electrical resistance path and the electrical conductive path. Disposed along the electrical conductive path is a non-conductive lubricant material. The electrical conductive path includes one or more protruding ridges spaced along one surface of the electrical conductive path. The ridges are formed of an electrically resistive thick film or ink material. The ridges serve to help insure that the control device does not suffer from current interruptions. The contactor includes a pad for engaging the ridges. The pad includes a length and a width. The length or width of the pad is greater in dimension than either the shorter of the length or the width of at least one of the ridges.

The foregoing and other features of the invention are hereinafter more fully described and particularly pointed out in the claims, the following description and drawings setting forth in detail certain illustrative embodiments of the invention, these being indicative, however, of but a few of the various ways in which the principles of the invention may be employed.

DESCRIPTION OF THE PREFERRED EMBODIMENTS

Figure 1:
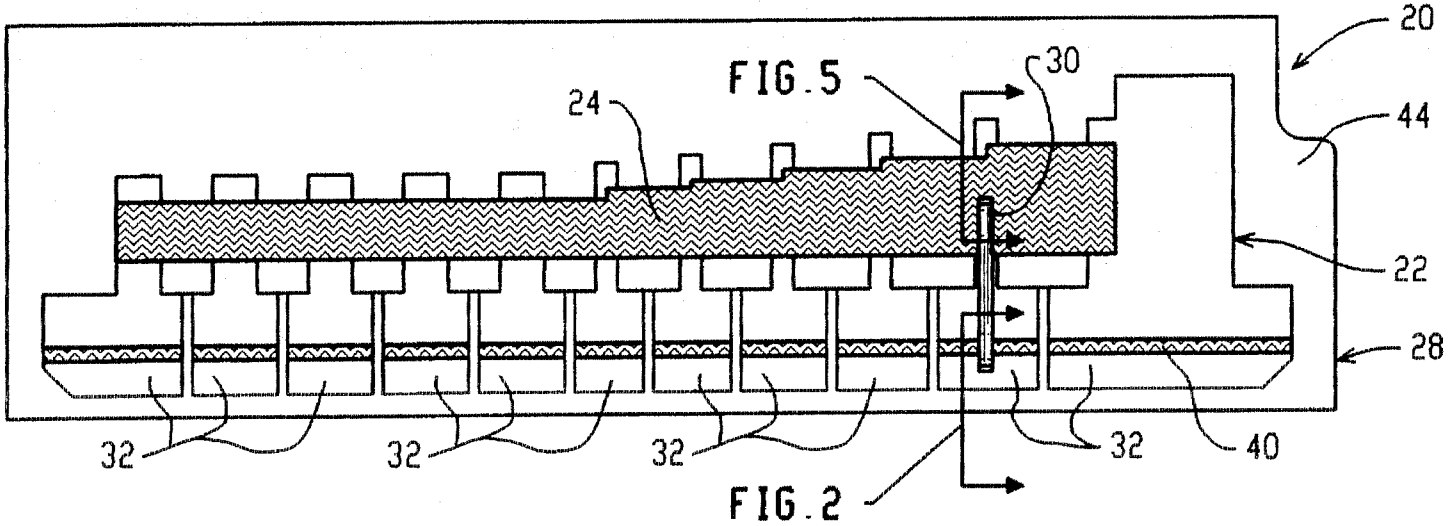
FIG. 1 is top view of a portion of a variable resistance control device made in accordance with the principles of the present invention.
Figure 2:
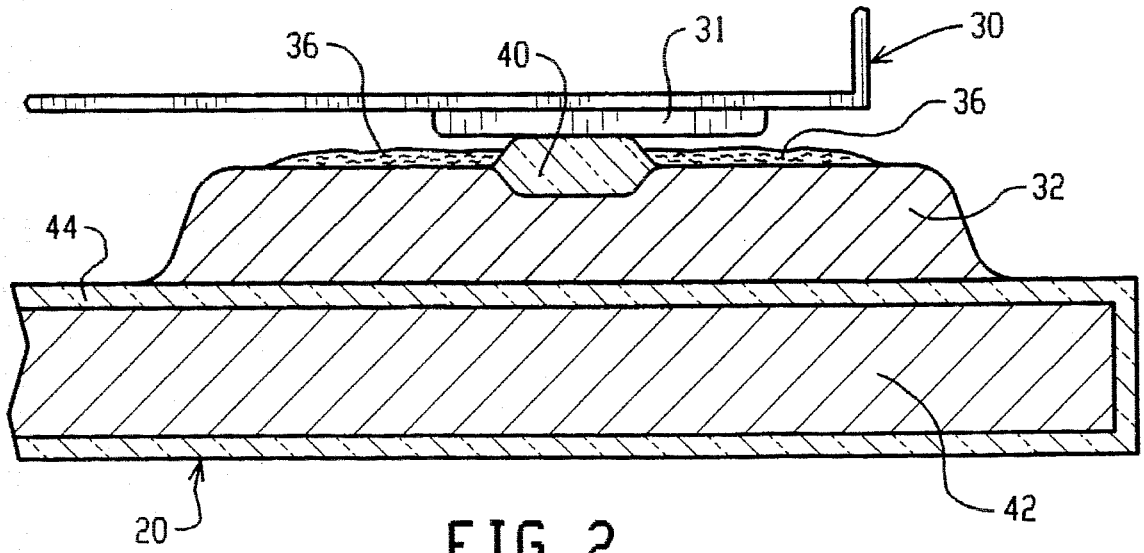
FIG. 2 is a cross-sectional view of the variable resistance control device of FIG. 1 taken along line 2—2 thereof.

Referring to the drawings and initially to FIGS. 1 and 2 there is illustrated in part a variable resistance control device 20 made in accordance with the present invention. In order to facilitate the illustration of the control device 20, no housing, control knob or leads are illustrated.

Variable resistance control device 20 comprises a conductive path 22 and a resistance path 24 formed upon a base 28. Bridging the resistance path 24 and the conductive path 22 is a contactor or wiper 30 having pads 31 for contacting the resistance path 24 and the conductive path 22. The conductive path 22 is formed by a plurality of individual conductive pads 32. Bridging the narrowed upper ends of the conductive pads 32 is the continuous resistance path 24. Resistance path 24 along with conductive path 22 form a series of discrete resistors along the length of the control device 20. Although not shown in FIG. 1, the conductive path 22 includes a thin layer of conventional non-conductive lubricant. Such lubricant is indicated at 36 in FIG. 2.

Formed along the top surface of the conductive pads 32 is a discontinuous strip of resistive material that forms multiple protruding ridges 40. Protruding ridges 40 are formed by overprinting a resistive thick film or ink over the conductive pads 32. The overprint protruding ridges 40 may be discontinuous as shown or they may be continuous with no breaks between pads 32 when the overprinted resistor value is at least about 200 times that of each of the discrete resistors formed along the resistance path 24. For example, a discrete resistor of value 0.5 Ohms can be accompanied by a continuous overprinting which places a 100 Ohm resistor in parallel to it. This reduces the desired 0.5 Ohm resistor to 0.4975 Ohms. However, because the thickness of the overprint adds resistance in series, the slight resistance difference may be offset. Each contactor, resistor overprint configuration and discrete resistance situation must be considered specifically to obtain the correct combination of thick film design and materials with respect to the contactor and circuit function.

In situations involving low resistance overprinting, the overprint must be confined to the extent of the individual conductor pads as shown in FIG. 1. Low resistance overprints that extend so far as to contact neighboring pads can result in an unintentional low resistance current path which runs in parallel to the intended discrete resistor or load thereby significantly lowering the apparent discrete resistance.

Base or substrate 28 may comprise any one of a variety of materials. As shown in the drawings, base 28 comprises a steel substrate 42 coated along all sides with porcelain enamel 44. Such porcelain enamel coated substrates are commercially available from the Ferro-ECA Electronics Company located in Erie, Pa. In addition to a porcelain enameled metal substrate, it will be appreciated that base 28 may comprise any number of other conventional substrate materials such as, for example, aluminum nitride (AlN), alumina ($Al_2O_3$) and beryllium oxide (BeO).

The resistance path 24 and the conductive path 22 are formed in a conventional manner using a suitable commercially available thick film or ink. Such thick film or ink is printed on the base 28 using conventional techniques, such as, for example, screen printing. Examples of other possible, but generally less desirable application techniques other than screen printing include, for example, spraying, dipping, spinning, brushing and application using a doctor blade. The conductive path 22 may be formed, for example, using a silver cermet thick film conductor sold under the trade designation ESL 9996-B by Electro Science Labs. The conductor material is dried after application and then a cermet resistor thick film material such as a thick film sold by Electro Science Labs under the trade designation ESL 3100 is applied to form the resistance path 24 and the protruding ridge 40. The resistor thick film is then dried and the assembly is then fired at about 625° C. It will be appreciated that it is not necessary that the ridge be printed as an integral part of some existing resistor printing. Specifically, a separate printing may be performed for the ridge so as to enable the use of a specific material that would deliver the desired electrical affect. This choice may relate to wear characteristics, current carrying or tactile response among other things. Lubricant 36 may comprise any commercially nonconductive lubricant. An example of such a lubricant is a high performance fluorinated lubricant/grease sold under the registered trademark KRYTOX by the Miller-Stephenson Chemical Co., Inc. of Sylmar, Calif. An example of another suitable lubricant is a fluoroether grease sold under the trade designation 842 by the William F. Nye, Inc. of New Bedford, Mass.

In the embodiment illustrated in FIGS. 1 and 2, the protruding ridges 40 are about 8 microns above the top surface of the conductor pads 32 which are about 15 to 30 microns above the top surface of the substrate 28. The overprint or ridge thickness dimension is important in that it provides a high point along the entire length of the conductive path 22 which functions as the primary contact against the flat faced pad 31 of the wiper 30. The ridges 40 running parallel to the travel of the wiper 30, hold the wiper pads off the surface of the conductor pads 32. When lubricant is added to the conductive path 22, including the ridges 40, it is not immediately wiped away during the first few strokes of the wiper as is normally true for the prior art wipers. The areas below the ridge act as a reservoir for lubricant. This attribute, during the normal wear life of the control, will provide lubricant continuously as the contact surfaces of the wiper and ridge wear away with respect to each other and the wiper penetrates deeper into the lubricant reservoir. During normal wear, the frictional characteristics of the "worn in" or "broken in" wiper and conductive path will be sufficiently polished to present a pleasant tactile character while maintaining a highly conductive low friction interconnection.

One important feature of the contactor 30 is that the pad 31 that contacts the ridges 40 must have a width or length that is greater in dimension than the smallest dimension of the ridges 40. In most instances thus, as illustrated in FIG. 2, the pad 31 has a width that is much greater than the width of the ridges 40. This feature is important because it ensures the proper distribution of the lubricant 36.

Figure 3:
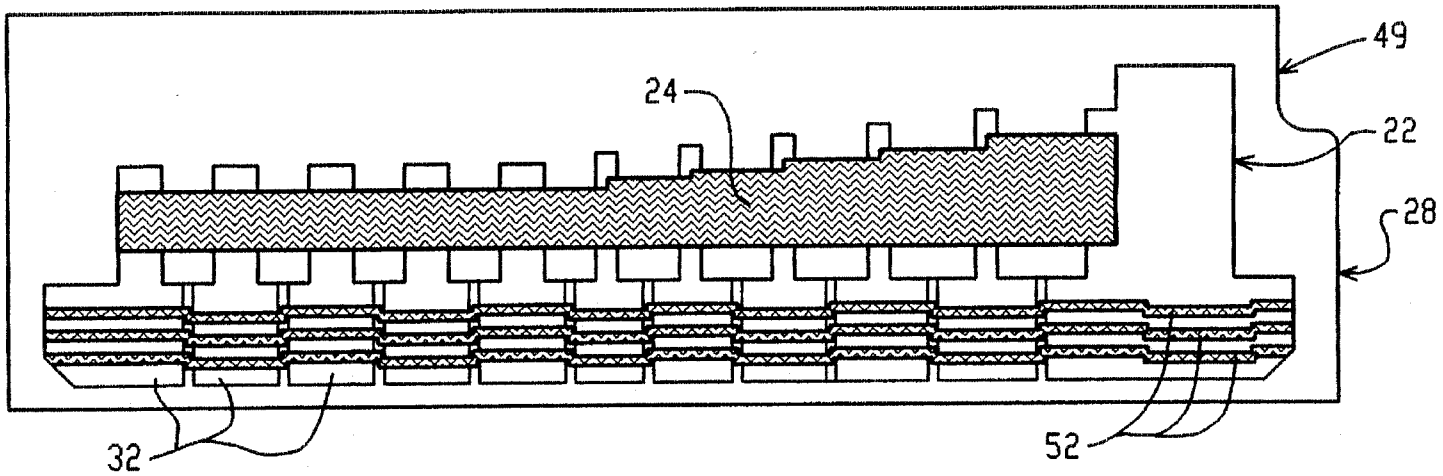
FIG. 3 is a top view of a portion of another embodiment of a variable resistance control device made in accordance with the principles of the present invention.

Referring now to FIG. 3 there is illustrated another embodiment of the invention. This embodiment illustrates a variable control device wherein the protruding ridges comprise two or more rows of ridges. The variable resistance control device 49 of FIG. 3 is substantially similar to that of FIG. 1 with the exception that the conductive path 22 includes multiple rows (i.e., three rows) of continuous protruding ridges 52. Like numerals have been utilized to designate features in FIG. 3 that are similar to those shown in FIGS. 1 and 2.

Figure 4:
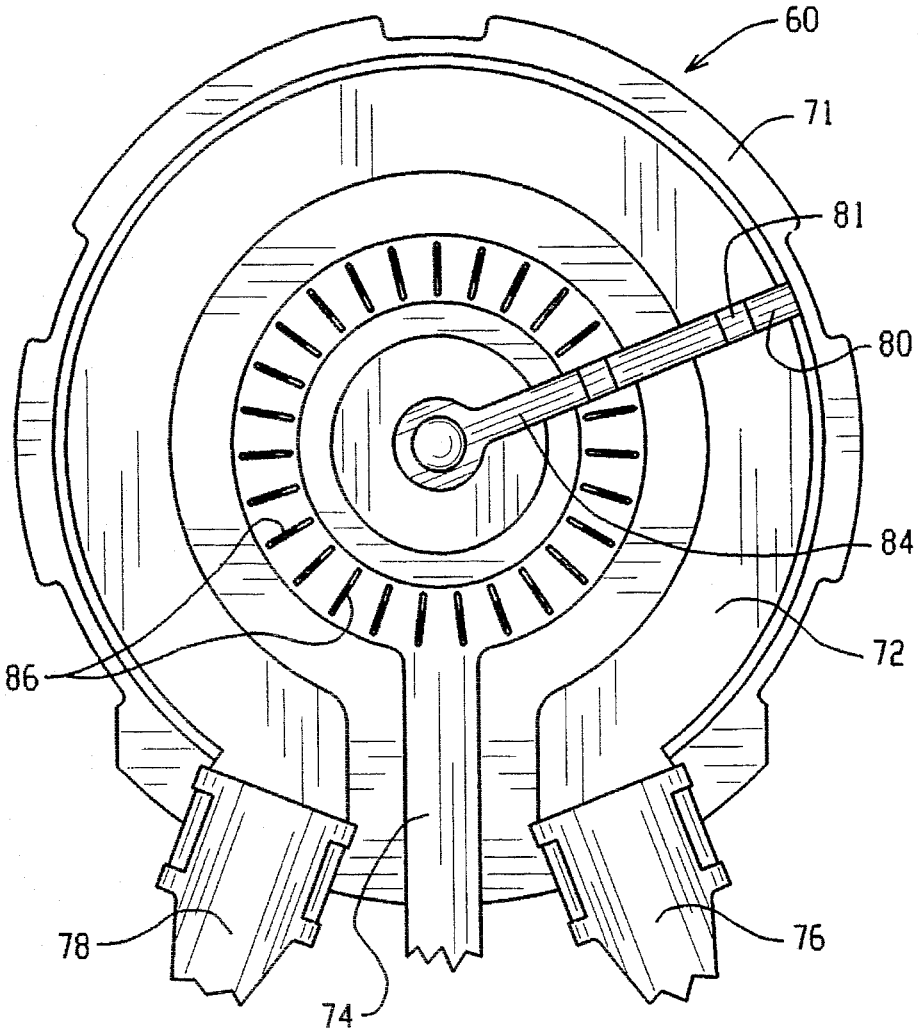
FIG. 4 is top view of a portion of yet another embodiment of a variable resistance control device made in accordance with the principles of the present invention.
Figure 5:
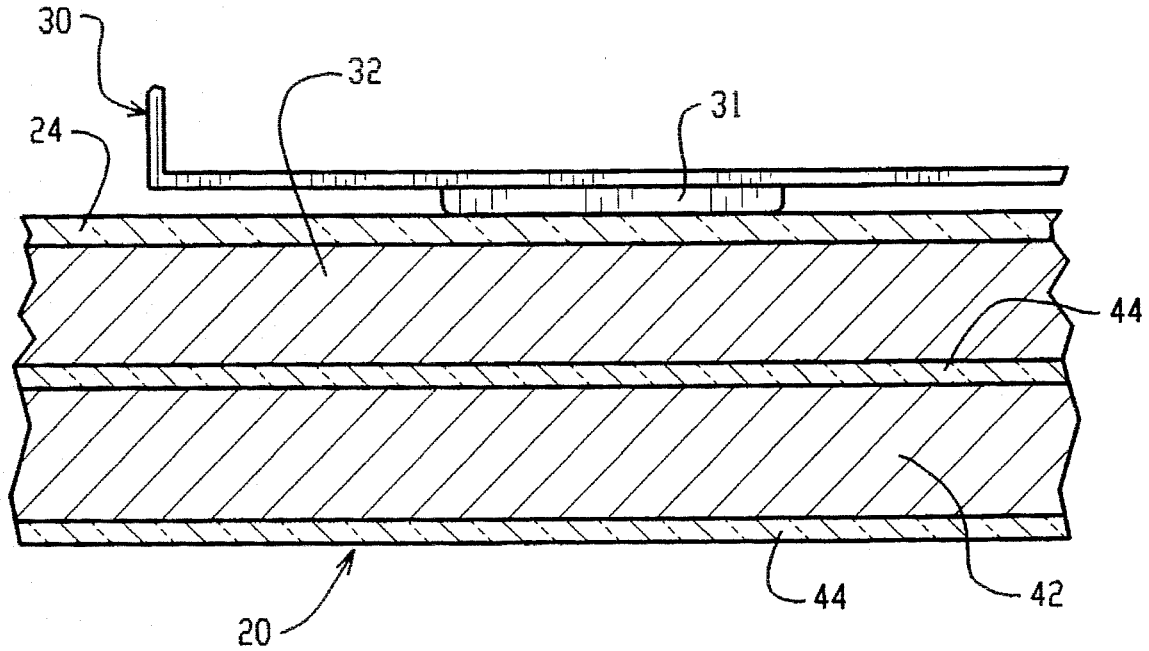
FIG. 5 is a cross-sectional view of the variable resistance control device of FIG. 1 taken along line 5—5 thereof.

Referring now to FIG. 4 there is illustrated yet another embodiment of the invention. The variable resistance control device 60 of FIG. 4 includes a porcelain enamel base 71, a resistance path 72, a conductive path 74, electrical terminals 76 and 78 and a contactor or wiper 80 electrically bridging the resistance path 72 and conductive path 74. The wiper is connected to a rotatable shaft 84. Included along the conductive path 74 are multiple protruding ridges 86 formed of resistive thick film material. Wiper 80 includes pads 81. Pads 81 have a width that is much greater than the width of the ridges 86. As discussed above, depending upon the resistance value of the resistance path, it may be necessary to form multiple discontinuous protruding ridges (as in FIG. 1) instead of the illustrated continuous protruding ridges 86. It will be appreciated that the ridges 86 may be oriented in various manners other than the perpendicular orientation shown in FIG. 4. For example, the ridges 86 may be oriented at an angle of 0 to 45 degrees from the travel direction of the wiper 80, at 0 degrees the ridges being oriented much like in FIG. 1. Alternatively, when oriented at an angle of 0 to 45 degrees, the ridges 86 may be formed in multiple rows much like that shown in FIG. 3.

It will be appreciated that the principles of the present invention may be employed in conjunction with variable resistance control devices having conductive and resistance paths of various configurations, and the invention is in no way limited to the linear and circular configurations shown respectively in FIGS. 1 and 4. Similarly, there are a number of permissible alternatives relative to the configuration of the protruding ridge(s). A "detent like" feel may be introduced to the control device when multiple ridges are utilized that are formed substantially perpendicular to the wiper travel direction as in the control device of FIG. 4. This bumpy feel may be useful in giving the human operator a sense of more specific control over the control device. The perception of selectable quality may be enhanced by moving away from a flat wiper contact pad to a slightly rounded cross section depending on the current required.

While the invention has been shown and described with respect to specific embodiments thereof, this is intended for the purpose of illustration rather than limitation, and other variations and modifications of the specific devices herein shown and described will be apparent to those skilled in the art all within the spirit and scope of the present invention. Accordingly, this patent is not to be limited in scope and effect to the specific embodiments herein shown and described nor in any other way that is inconsistent with the extent to which the progress in the art has been advanced by the invention.

I claim:

1. A variable resistance control device comprising a substrate having formed thereon an electrical resistance path and an electrical conductive path, and a movable contact electrically bridging said electrical resistance path and said electrical conductive path, and a lubricant material disposed along said electrical conductive path, said electrical conductive path including one or more protruding ridges spaced along one surface of said electrical conductive path, said one or more protruding ridges being formed of an electrically resistive material, said resistance path forming a series of discrete resistance.

2. A device as set forth in claim 1 wherein said one or more protruding ridges comprise a post-fired resistive thick film or ink.

3. A device as set forth in claim 1 wherein said electrical conductive path comprises a post-fired-conductive thick film or ink.

4. A device as set forth in claim 1 wherein said resistance path comprises a post-fired resistive thick film or ink.

5. A device as set forth in claim 1 wherein said resistance path and said conductive path are substantially linear in configuration.

6. A device as set forth in claim 1 wherein said resistance path and said conductive path are substantially circular in configuration.

7. A device as set forth in claim 1 wherein said one or more protruding ridges comprise a single ridge running continuously along said conductive path substantially parallel to the travel path of said movable contact.

8. A device as set forth in claim 1 wherein said one or more protruding ridges comprise two or more rows of ridges which extend substantially parallel to one another.

9. A device as set forth in claim 1 wherein said lubricant comprises a non-conductive lubricant.

10. A device as set forth in claim 1 wherein said movable contact includes a pad for contacting said one or more protruding ridges, said pad having a length and a width, the dimension of said length or said width of said pad being greater than the shorter of the length or width of at least one of said protruding ridges.

11. A device as set forth in claim 1 wherein said substrate comprises a material selected from the group consisting of porcelain enamel, BeO, AlN and alumina.

12. A variable resistance control device comprising a substrate having formed thereon an electrical resistance path and an electrical conductive path, and a movable contact electrically bridging said electrical resistance path and said electrical conductive path, and a lubricant material disposed along said electrical conductive path, said electrical conductive path including one or more protruding ridges spaced along one surface of said electrical conductive path, said one or more protruding ridges being formed of an electrically resistive material, said one or more protruding ridges comprising multiple individual protruding ridges extending substantially perpendicular to the travel path of said movable contact.

13. A device as set forth in claim 12 wherein said one or more protruding ridges comprise a post-fired resistive thick film or ink.

14. A device as set forth in claim 12 wherein said electrical conductive path comprises a post-fired conductive thick film or ink.

15. A device as set forth in claim 12 wherein said resistance path comprises a post-fired resistive thick film or ink.

16. A device as set forth in claim 15 wherein said one or more protruding ridges comprise a single ridge running continuously along said conductive path.

17. A device as set forth in claim 12 wherein said one or more protruding ridges comprise two or more rows of ridges which extend substantially parallel to one another.

18. A device as set forth in claim 12 wherein said lubricant comprises a non-conductive lubricant.

19. A device as set forth in claim 12 wherein said movable contact includes a pad for contacting said one or more protruding ridges, said pad having a length and a width, the dimension of said length or said width of said pad being greater than the shorter of the length or width of at least one of said protruding ridges.

20. A device as set forth in claim 12 wherein said substrate comprises a material selected from the group consisting of porcelain enamel, BeO, AlN and alumina.

* * * * *